US009980548B1

(12) United States Patent
Lai

(10) Patent No.: US 9,980,548 B1
(45) Date of Patent: May 29, 2018

(54) HANDLE FOR LUGGAGE

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 0 days. days.

(21) Appl. No.: 15/649,212

(22) Filed: Jul. 13, 2017

(30) Foreign Application Priority Data

May 31, 2017 (TW) ..... 106117962 A

(51) Int. Cl.
*A45C 3/00* (2006.01)
*A45C 13/26* (2006.01)

(52) U.S. Cl.
CPC ..... *A45C 13/26* (2013.01)

(58) Field of Classification Search
CPC ... Y10T 16/455; Y10T 16/513; Y10T 16/473; A45C 13/26; A45C 13/22; A45C 13/262; A45C 13/265; A45C 13/267; A45F 5/10; A45F 5/1026
See application file for complete search history.

(56) References Cited

U.S. PATENT DOCUMENTS 3,219,160 A * 11/1965 Szabo ..... A45C 13/26 190/115
3,289,798 A * 12/1966 Gehrie ..... A45C 13/26 16/405
3,340,970 A * 9/1967 Szabo ..... A45C 13/26 190/115
3,372,780 A * 3/1968 Fujioka ..... A45C 13/26 16/405
3,431,586 A * 3/1969 Bush ..... A45C 13/26 16/405
3,438,467 A * 4/1969 Milette ..... A45C 13/26 16/405
3,566,436 A * 3/1971 Marks et al. ..... A45C 13/26 16/405
4,002,386 A * 1/1977 McKenzie ..... A47B 95/02 16/444
6,658,698 B2 * 12/2003 Chen ..... A45C 13/26 16/111.1
8,453,297 B2 * 6/2013 Wang ..... G06F 1/1616 16/114.1
8,579,345 B2 * 11/2013 LeClaire ..... A45F 5/10 16/422
9,060,591 B1 * 6/2015 White ..... A45F 5/10
2001/0034923 A1 * 11/2001 Ho ..... A45C 13/26 16/114.1
2002/0124352 A1 * 9/2002 Lin ..... A45C 13/26 16/410
2004/0182667 A1 * 9/2004 Lin ..... A45C 13/26 190/115
2006/0064852 A1 * 3/2006 Willems ..... A45F 5/1026 16/444

* cited by examiner

*Primary Examiner* — Chuck Mah
(74) *Attorney, Agent, or Firm* — Wang Law Firm, Inc.

(57) ABSTRACT

A handle of a luggage includes a main member and two elastic members embedded in the main member. The main member has two hollow portions, each of which has a plurality of alternate spacers and recesses, and the elastic members pass through the spacers and the recesses and have opposite ends fixed to the main member. The main member is moved away from the surface of the case and the elastic members are deformed when a user holds the main member to lift the case, and the main member is moved to an initial position by the elastic members when the user releases the main member.

5 Claims, 11 Drawing Sheets

HANDLE FOR LUGGAGE

BACKGROUND OF THE INVENTION

1. Technical Field

The present invention relates to a luggage, and more particularly to a handle for a luggage.

2. Description of Related Art

Typically, a conventional luggage is provided with a U-shaped handle pivoted on a case. The handle is leaned down on the case normally, and user has to grip it upwards to carry the luggage. A drawback the conventional handle is that it is free to rotate, so that the handle will move unexpectedly when a user move the luggage.

An improved handle of a luggage is made of a flexible material. The improved handle will be attached to a case normally, and a user may grip it outwards to carry the luggage, and the handle will return automatically when the user does not grip it. Such handle is easy to be broken since the handle is moved relative to the case repeatedly.

BRIEF SUMMARY OF THE INVENTION

In view of the above, the primary objective of the present invention is to provide a handle for a luggage, which has a strong structure and a great flexibility to have a stable operation and a great loading, and furthermore, it has a good looking.

In order to achieve the objective of the present invention, a handle, which is adapted to be mounted on a surface of a case, includes a main member having a hollow portion, wherein the hollow portion has a plurality of alternate spacers and recesses, and an elastic member passing through the spacers and the recesses and having opposite ends fixed to the main member. The main member is moved away from the surface of the case and the elastic member is deformed when a user holds the main member to lift the case, and the main member is moved to an initial position by the elastic member when the user releases the main member.

In an embodiment, the handle further includes two connecting arms connected to opposite ends of the main member and two connecting devices connected to the case. The connecting devices may be a combination of a base and a lid or a combination of a cover and an extending board to movably connect to the connecting arms.

In an embodiment, the main box is provided with at least a rib, or at least a concave portion to enhance a strength thereof.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
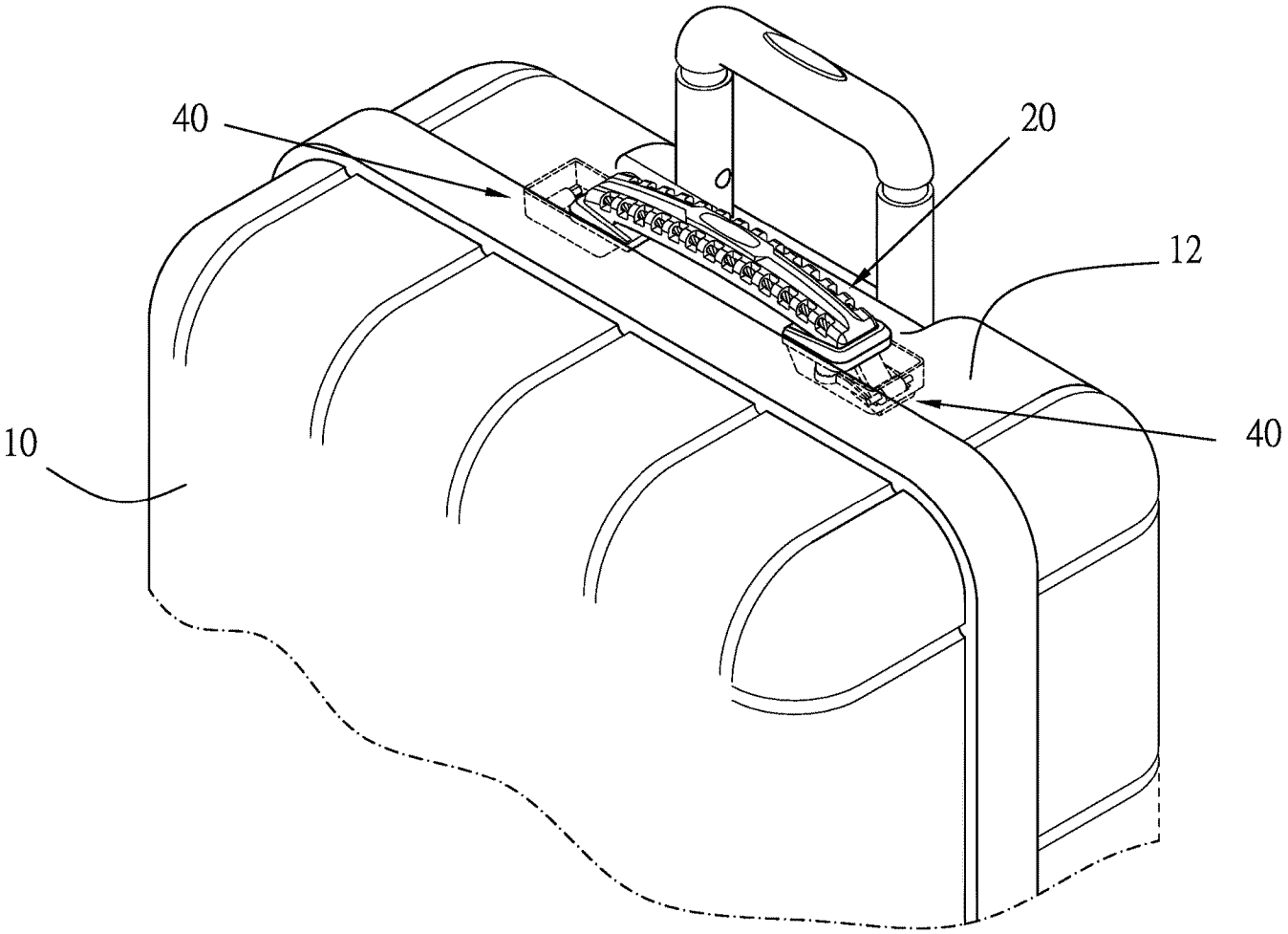
FIG. 1 is a perspective view of a first preferred embodiment of the present invention, showing the handle mounted on the case.

As shown in FIG. 1, a handle 20 of the first preferred embodiment of the present invention is mounted on a surface 12 of a case 10 through two connecting devices 40. The connecting devices 40 have the same structure, so we only describe one of them hereafter.

Figure 2:
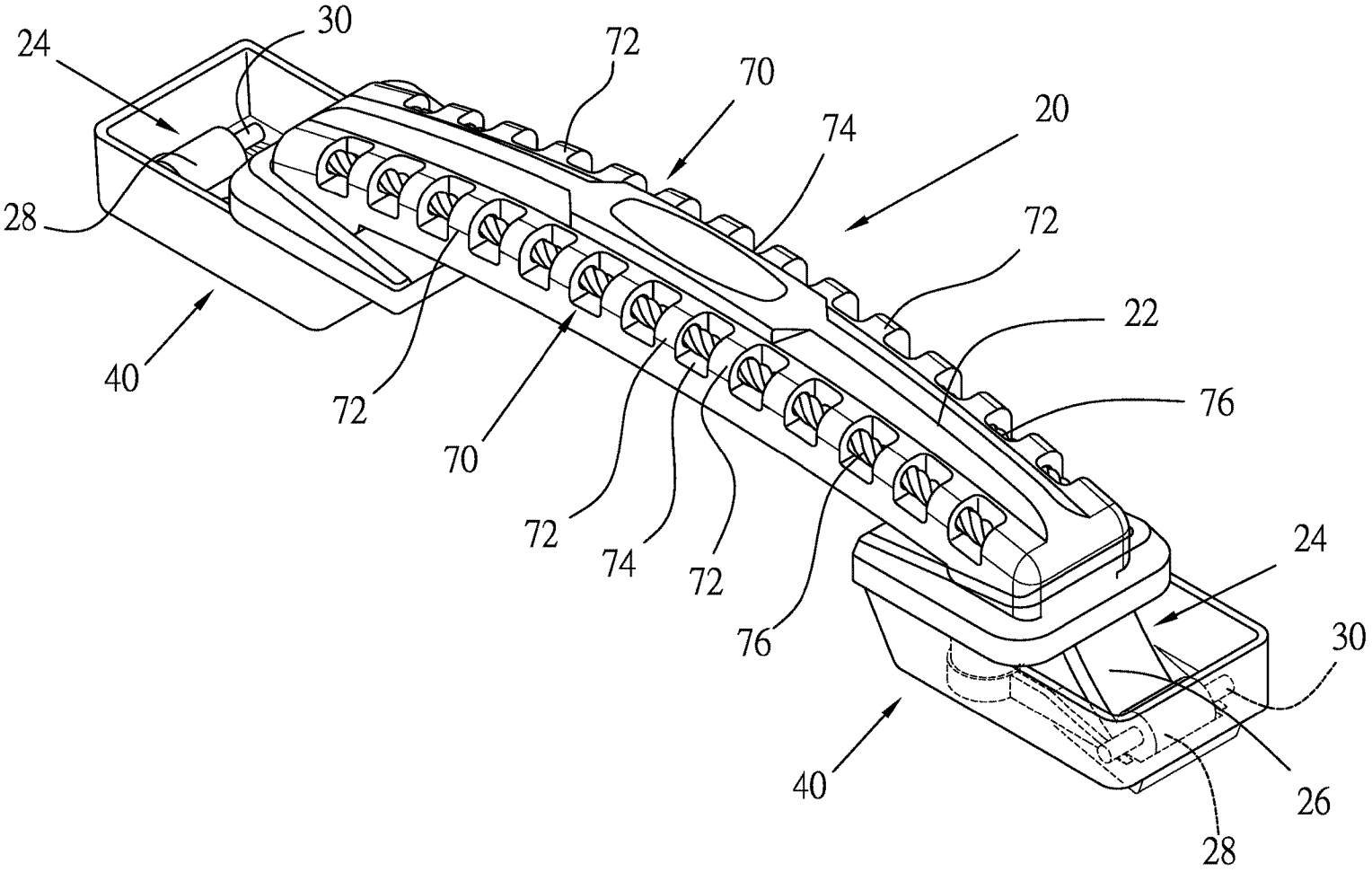
FIG. 2 is a perspective view of the first preferred embodiment of the present invention.
Figure 3:
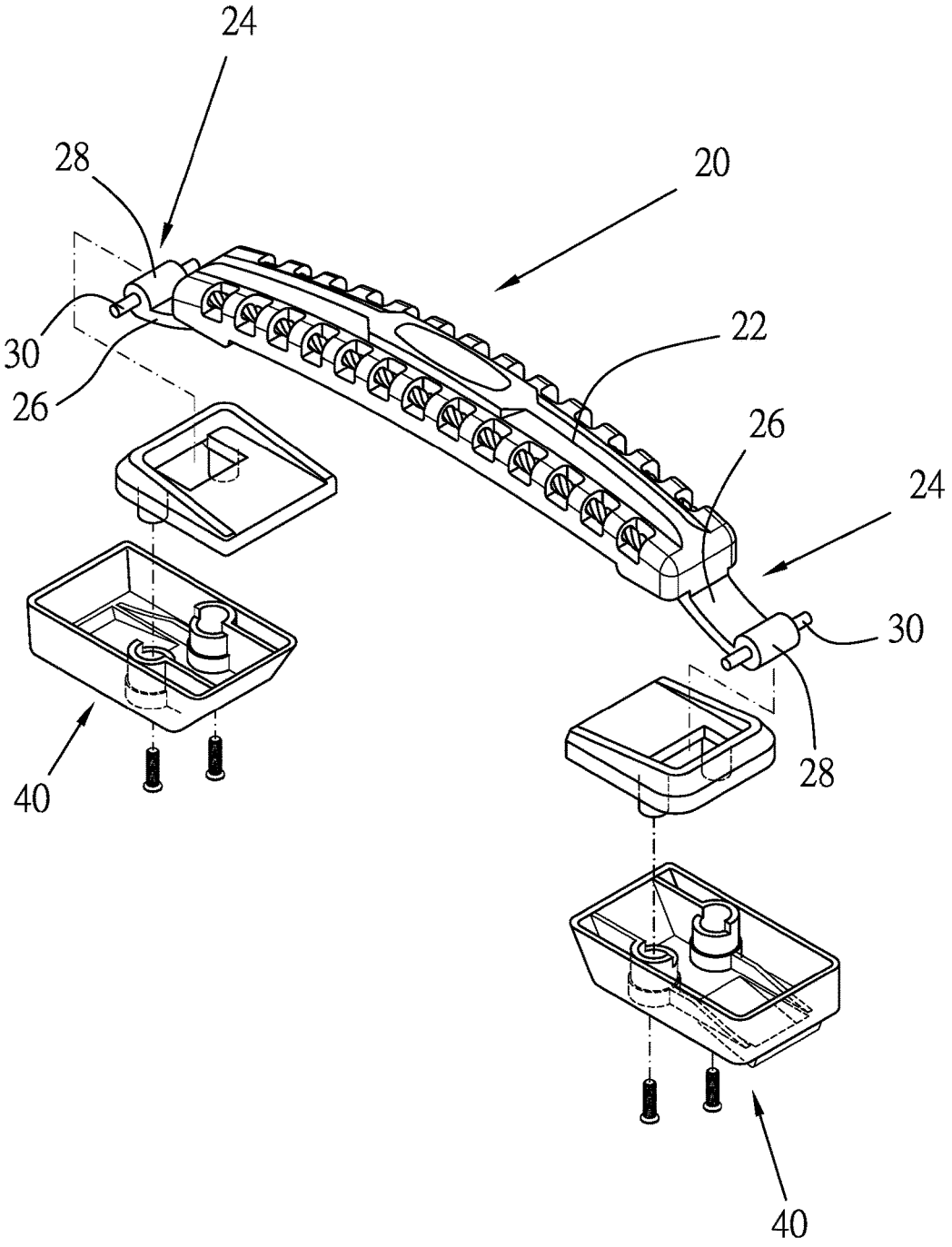
FIG. 3 is an exploded view of the first preferred embodiment of the present invention.

As shown in FIGS. 2 and 3, the handle 20 includes a main member 22 with two transmission assemblies 24 at opposite ends thereof. The transmission assemblies 24 are connected to the connecting devices 40 respectively. Each of the transmission assemblies 24 includes a connecting arm 26, a block 28 connected to the connecting arm 26, and a sliding rod 30. Opposite ends of the sliding rod 30 are projected from the block 28.

Figure 4:
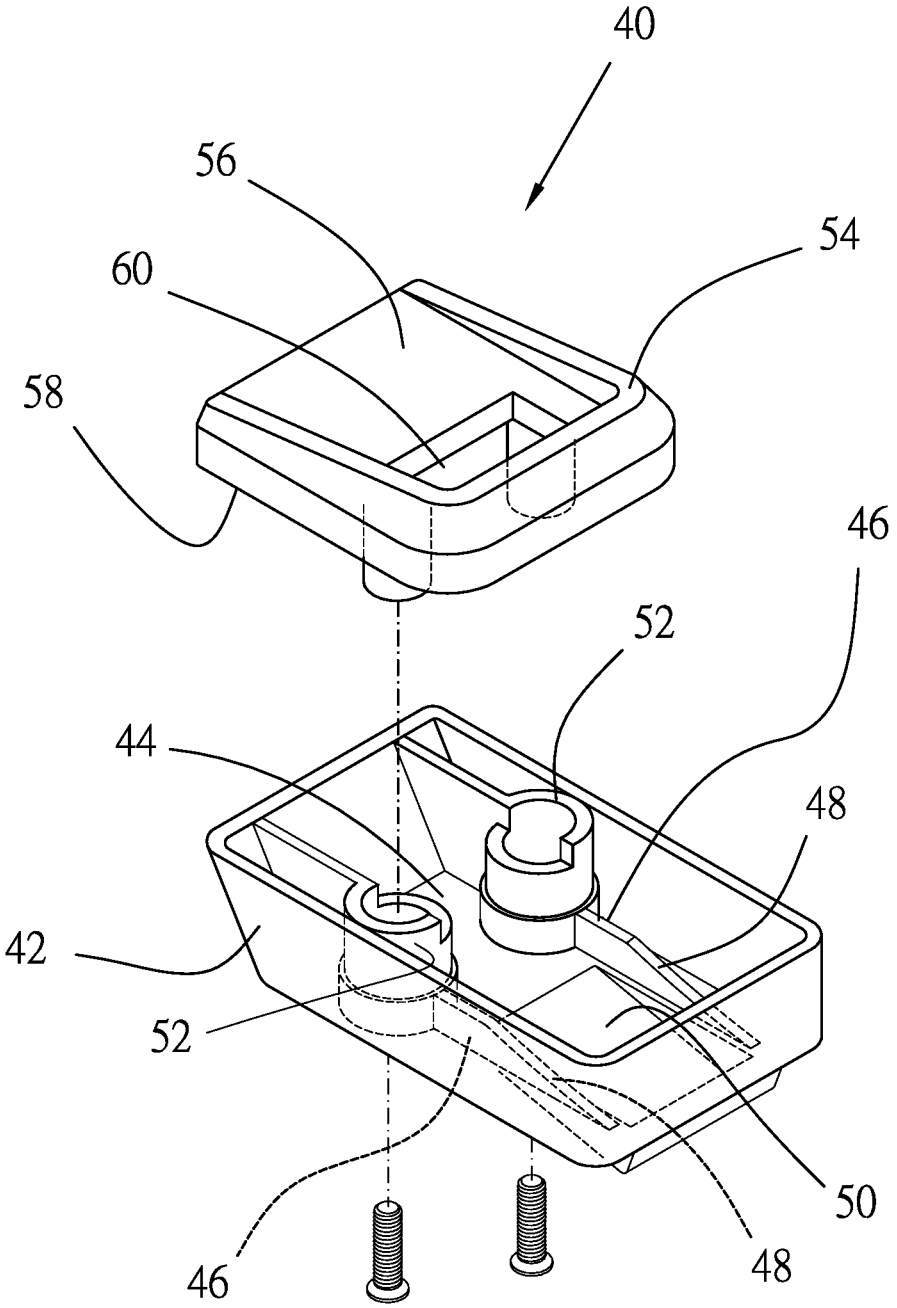
FIG. 4 is an exploded view of the connector of the first preferred embodiment of the present invention.

As shown in FIG. 4, each of the connecting devices 40 includes a base 42 and a pair of parallel rails 46 on a bottom 44 of the base 42. Each of the rails 46 has an inclined portion 48 at an end thereof The base 42 has a slot 50 on the bottom 44 between the rails 46 and two first tubes 52 projected from the bottom 44 at ends of the rails 46 opposite to the ends having the inclined portions 48. Each of the connecting devices 40 further includes a lid 54 connected to the base 42.

Figure 5:
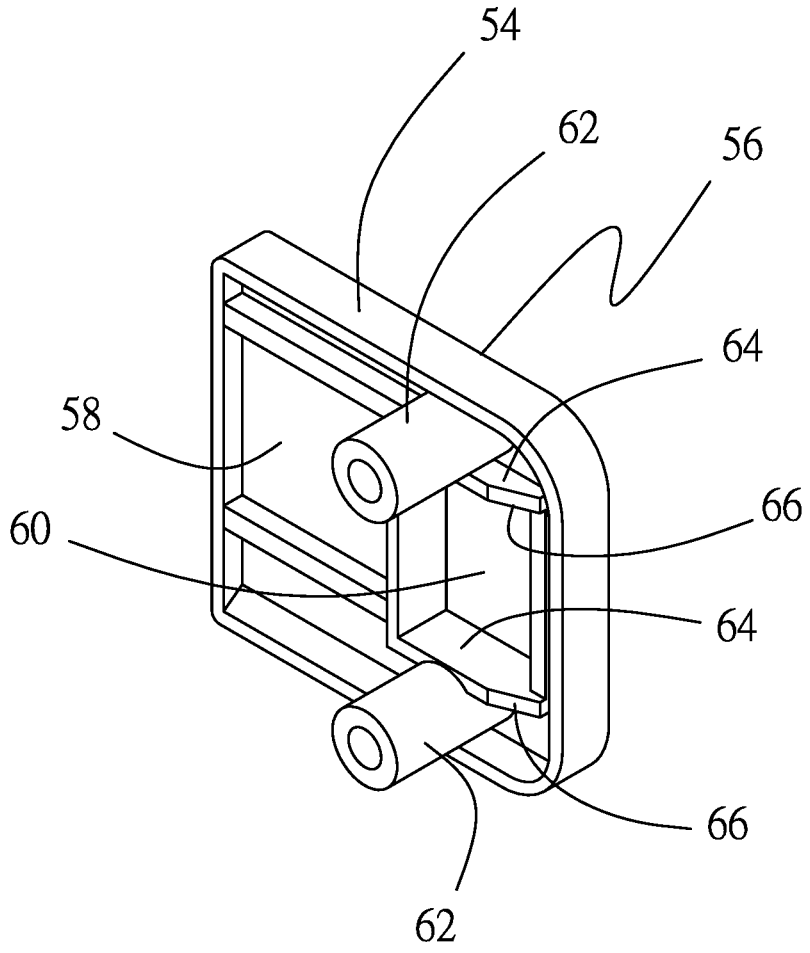
FIG. 5 is a perspective view of the first preferred embodiment of the present invention, showing the lid of the connector.

As shown in FIGS. 4 and 5, each of the lids 54 has a first side 56 and a second side 58 opposite to the first side 56. The first side 56 is inclined. The lid 54 has a through hole 60 having opposite ends thereof open at the first and the second sides 54, 56, two second tubes 62 on the second side 56, and two stop blocks 64 on the second side 56 beside the second posts 62 respectively. Each of the stop blocks 64 has an inclined portion 66 at an end.

Figure 6:
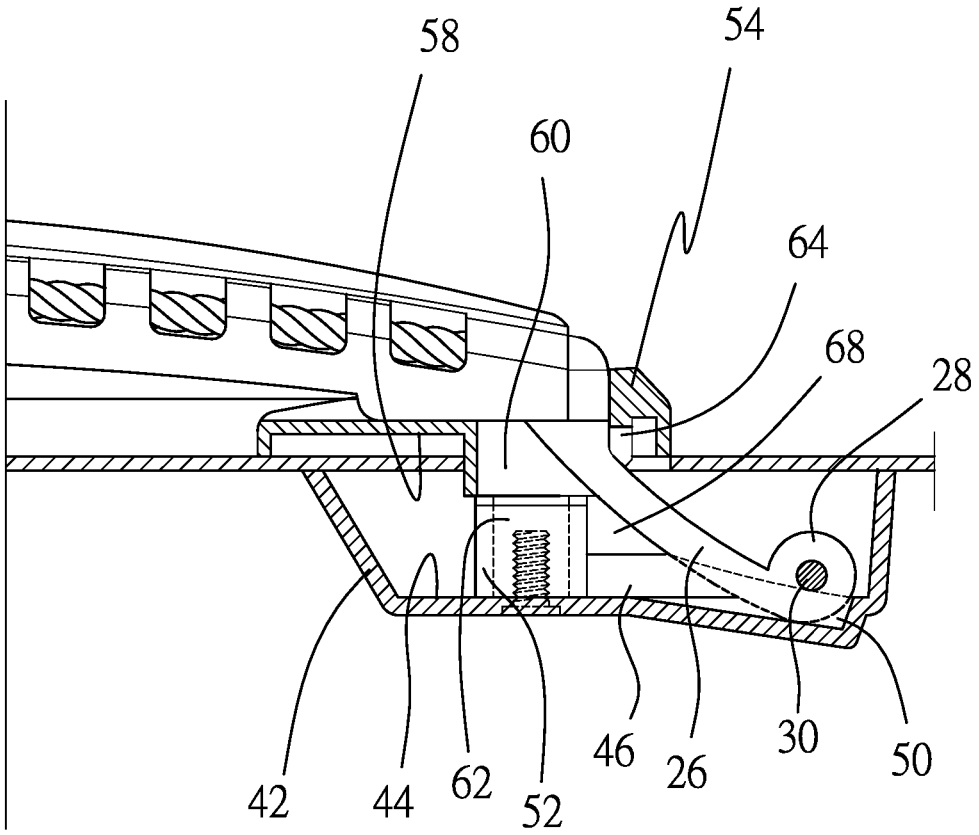
FIG. 6 is a partial sectional view of the first preferred embodiment of the present invention.

As shown in FIG. 6, the lid 54 is connected to the base 42 with the second side 58 facing the bottom 44 of the base 42. The second tubes 62 of the lid 54 are coupled to the first tubes 52 of the base 42 by suitable fasteners, such as bolts or screws. The stop blocks 64 correspond to the rails 46 and keep a movable space 68 therebetween. The connecting arms 26 respectively pass through the through holes 60 of the lids 54 with the blocks 28 received in the slots 50 of the bases 42 and the sliding rods 30 on the rails 46.

Figure 7:
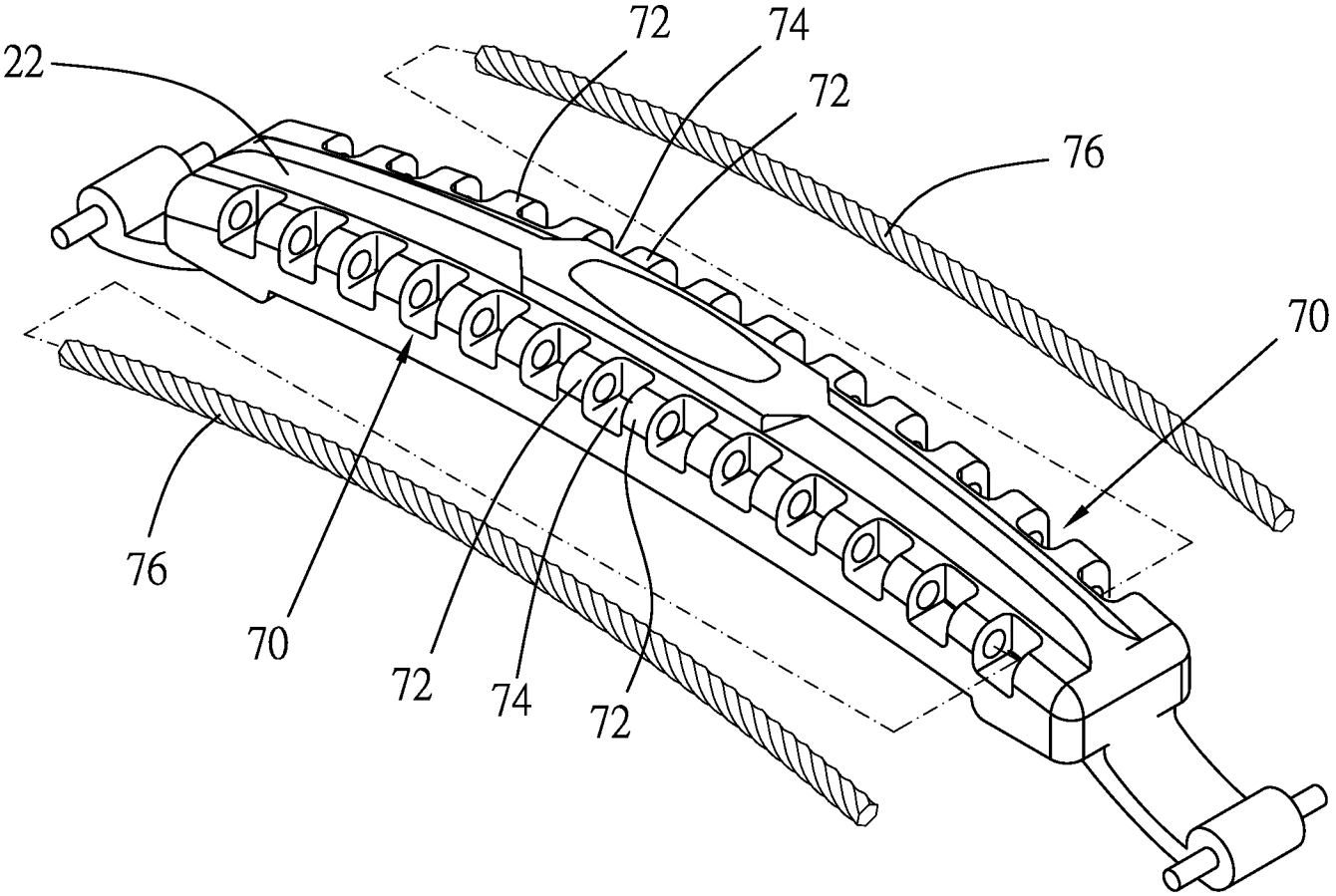
FIG. 7 is an exploded view of the first preferred embodiment of the present invention, showing the main member and the elastic member.

As shown in FIGS. 2 and 7, the main member 22 has two hollow portions 70, each of which has a plurality of alternate spacers 72 and recesses 74. Two elongated elastic members 76 pass through the spacers 72 and the recesses 74 respectively. Opposite ends of the elastic members 76 are coupled to the main member 22 to make the main member 22 flexible. In an embodiment, the elastic members 76 are two metallic cables.

In an embodiment, the main member 22 and the connecting arms 26 are made of a flexible material, and the metallic cables are embedded in the main member 22 to make the main member 22 flexible. The flexibility of the main member 22 and the elastic members 76 will attach the main member 22 to the case 10 initially.

Figure 8:
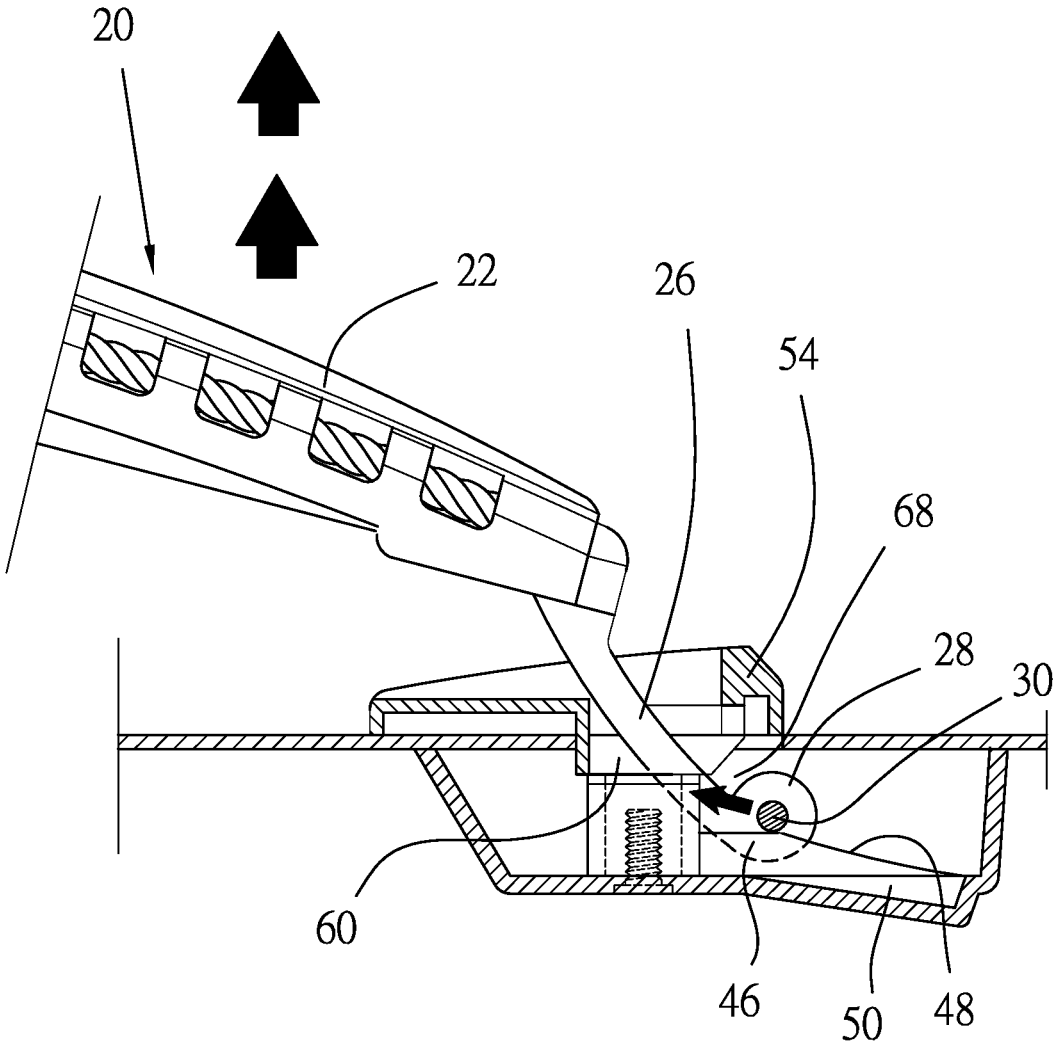
FIG. 8 a partial sectional view of the first preferred embodiment of the present invention.

As shown in FIG. 8, when a user holds the main member 22 of the handle 20 to lift the case 10, the blocks 28 on the connecting arms 26 move toward the lids 54, and the sliding rods 30 move on the rails 46. At this time, the sliding rods 30 are raised by the inclined portions 48 of the rails 46, and moved to the movable spaces 68 under the through holes 60. Since lengths of the sliding rods 30 are greater than the through holes 60, the connecting arms 26 and the sliding rods 30 are restricted in the connecting devices 40. The main member 22 of the handle 20 is moved away from the surface 12 of the case 10, and the main member 22 and the elastic members 76 are deformed to generate a recover force because of the flexibility.

The recover force of the main member 22 and the elastic members 76 will return the main member 22 automatically when the user releases the main member 22 of the handle 20. At this time, the sliding rods 30 move on the rails 46 until the blocks 28 are received in the slots 50.

The hollow portions 70 of the main member 22 and the elastic members 76 provide the main member with good flexibility and strength. Furthermore, the main member 22 has a fancy appearance. The sliding rods 30 move on the rails 46 to the movable spaces 68, so that the handle 20 of the first preferred embodiment may provide a stable and large loading. Besides, the first side 56 of the lid 54, on which the through hole 60 is provided, is inclined that benefits the connecting arm 26 through the through hole 60. The inclined portion 66 of the stop block 64 may guide the sliding rod 30 to the movable space 68.

Figure 9:
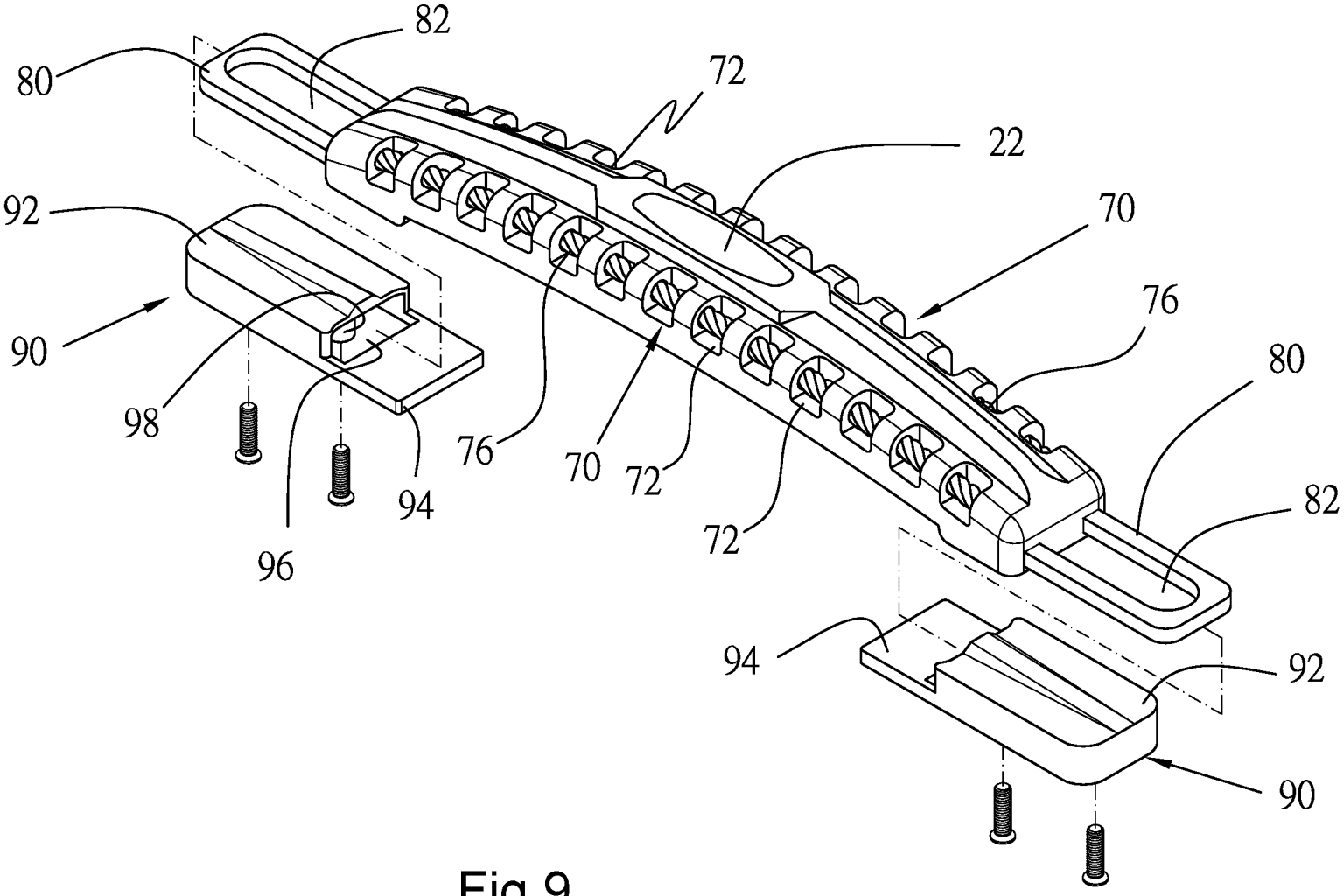
FIG. 9 is an exploded view of a second preferred embodiment of the present invention.

FIG. 9 shows a handle of the second preferred embodiment of the present invention, which is the same as the first preferred embodiment, except that the main member 22 is provided with two connecting arms 80 and two connecting devices 90. The main member 22 has the hollow portions 70, the recesses 72, and the elastic members 76. Each of the connecting arms 80 is provided with a sliding hole 82 through the connecting arm 80.

Figure 10:
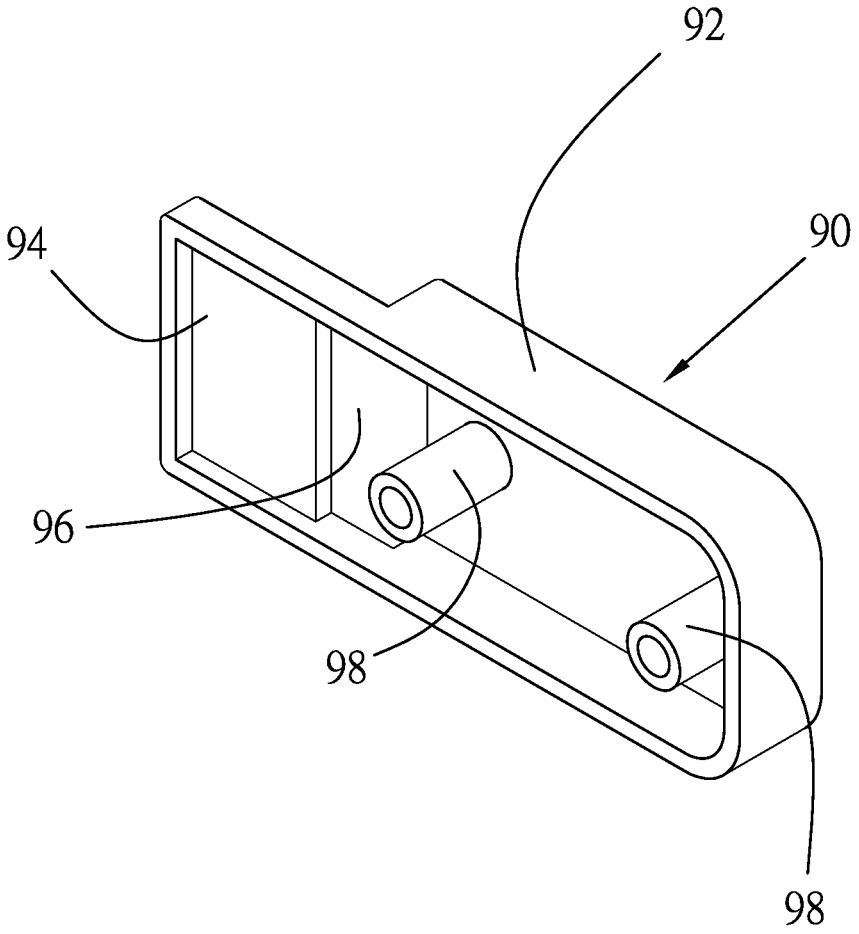
FIG. 10 is a perspective view of the connecting device of the second preferred embodiment of the present invention.

As shown in FIGS. 9 and 10, the connecting device 90 has a cover 92 and an extending board 94. The connecting device 90 further has a through hole 96 between the cover 92 and the extending board 94 and two locking rods 98 on a bottom of the cover 92.

Figure 11:
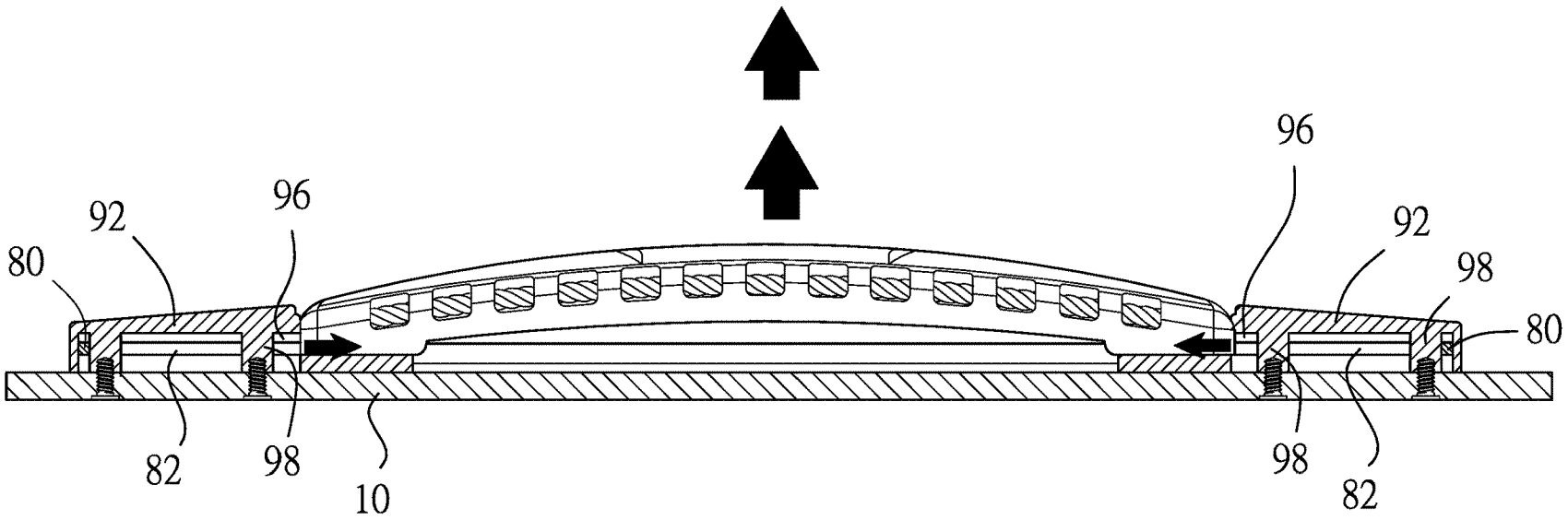
FIG. 11 is a sectional view of the second preferred embodiment of the present invention.

As shown in FIG. 11, the connecting arm passes through the through hole 96 to the bottom of the cover 92. The locking rod 98 passes through the sliding hole 82 of the connecting arm 80 to be fixed to the case 10 by a suitable fastener. When a user holds the main member 22 and lifts it, the connecting arms 80 move together with the main member 22, and the locking rod 98 moves in the sliding hole 82.

When the user releases the main member 22, the recover force of the main member 22 and the elastic members 76 moves the main member 22 toward the case 10. At this time, the sliding hole 82 moves relative to the locking rod 98 in an opposite direction until the main member 22 is attached to the case 10.

It must be pointed out that the embodiments described above are only some preferred embodiments of the present invention. All equivalent structures which employ the concepts disclosed in this specification and the appended claims should fall within the scope of the present invention.

What is claimed is:

1. A handle, which is adapted to be mounted on a surface of a case, comprising:

a main member having a hollow portion, wherein the hollow portion has a plurality of alternate spacers and recesses;

an elastic member passing through the spacers and the recesses and having opposite ends fixed to the main member;

wherein the main member is moved away from the surface of the case and the elastic member is deformed when a user holds the main member to lift the case, and the main member is moved back to an initial position by the elastic member when the user releases the main member; and two connecting arms connected to opposite ends of the main member and two connecting devices connected to the case, wherein the connecting arms are coupled to the connecting devices respectively;

wherein each of the connecting device includes a base connected to the case and a lid, further wherein the base has a bottom, on which a pair of rails are provided; the lid has a first side, a second side, and a through hole having opposite ends thereof open at the first and the second sides; the lid is connected to the base with the second side facing the bottom of the base; the connecting arm passes through the through hole to be connected to the rail.

2. The handle of claim 1, wherein each of the connecting arms has a block and a sliding rod projected from the block; the sliding rod touches the rails and moves on the rails; when the main member is lifted, the sliding rod moves toward the lid, and stops before the through hole, and when the main member is released, the sliding rod moves in an opposite direction to the initial position.

3. The handle of claim 1, wherein the lid is provided with two stop blocks on the second side, and the through hole is between the stop blocks; a movable space is formed between the stop blocks and the rails; the connecting arm is moved into or out of the movable space when the main member is moved.

4. The handle of claim 1, wherein the base is provided with a slot on the bottom thereof between the rails; the connecting arm is provided with a block between the rails; the block is received in the slot when the main member is moved to the initial position.

5. The handle of claim 1, wherein each of the connecting arms has an elongated sliding hole; each of the connecting devices has a cover, an extending board, and a through hole between the cover and the extending board; the connecting device further has at least a locking rod on a bottom of the cover; the connecting arm passes through the through hole of the connecting device; the locking rod passes through the sliding hole of the connecting arm; the locking rod moves in the sliding hole when the main member is moved.

* * * * *